US005953767A

United States Patent [19]

Cloffey

[11] Patent Number: 5,953,767

[45] Date of Patent: Sep. 21, 1999

[54] AUXILIARY CHILDREN'S POOL APPARATUS

[76] Inventor: Terry J. Cloffey, 590 Maloy Rd., Griffin, Ga. 30224

[21] Appl. No.: 08/994,673

[22] Filed: Dec. 19, 1997

[51] Int. Cl.[6] ..... E04H 4/04; E04H 4/14

[52] U.S. Cl. ..... 4/487; 4/495; 4/505; 4/506; 4/507; 108/66

[58] Field of Search ..... 4/487, 489, 505, 4/506, 507, 495, 496, 488; 108/66, 65, 147.21, 147.19

[56] References Cited

U.S. PATENT DOCUMENTS

| | | | |
|---|---|---|---|
| 3,026,538 | 3/1962 | Boyd et al. | 4/487 |
| 3,339,213 | 9/1967 | Spencer | 4/507 X |
| 3,813,703 | 6/1974 | Beaudin, Jr. | 4/487 |
| 3,874,005 | 4/1975 | Badon | 4/487 |
| 4,008,497 | 2/1977 | Badon | 4/487 |
| 4,124,906 | 11/1978 | Millard et al. | 4/487 |
| 4,126,905 | 11/1978 | Russell et al. | 4/489 X |
| 4,145,770 | 3/1979 | Zaris | 4/487 X |
| 4,623,126 | 11/1986 | Pettit | 4/496 X |
| 4,706,307 | 11/1987 | Smith | 4/487 |
| 4,860,914 | 8/1989 | Derni et al. | 4/506 X |
| 5,083,327 | 1/1992 | Gillebaard | 4/506 |
| 5,231,807 | 8/1993 | Aymes | 4/506 X |

*Primary Examiner*—Henry J. Recla
*Assistant Examiner*—Kathleen J. Prunner
*Attorney, Agent, or Firm*—Henderson & Sturm

[57] ABSTRACT

An auxiliary children's pool apparatus 10 for providing an adjustable height support enclosure above the bottom 101 of a conventional above ground swimming pool construction 100. The apparatus 10 includes a framework unit 11, a floor unit 12, an enclosure unit 13, and a netting unit 14. The framework unit 11 is adjustable to vary the height of the floor unit 12 relative to the bottom 101 of the pool 100.

14 Claims, 2 Drawing Sheets

AUXILIARY CHILDREN'S POOL APPARATUS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of swimming pool constructions in general, and in particular to an auxiliary children's pool that can be created within the confines of a standard above ground pool.

2. Description of Related Art

As can be seen by reference to the following U.S. Pat. Nos. 3,874,005; 4,008,497; 4,124,906; and 4,706,307, the prior art is replete with myriad and diverse adjustable height swimming pool enclosure insert devices.

While all of the aforementioned prior art constructions are more than adequate for the basic purpose and function for which they have been specifically designed, they are uniformly deficient with respect to their failure to provide a simple, efficient and practical adjustable height apparatus having an adjustable central support framework, as well as providing means to facilitate the ingress and egress of a child relative to the apparatus.

Unfortunately, for the consumer all of the prior art constructions employ a rigid box like framework arrangement that requires a child to either climb over or be lifted over the top of the enclosure which substantially reduces the practicality of such a device.

As a consequence of the foregoing situation, there has existed a longstanding need for a new and improved auxiliary children's pool apparatus that incorporates an adjustable central support framework for the floor of the apparatus, as well as means for facilitating the entrance and exit of a child relative to the apparatus, and the provision of such a construction is a stated objective of the present invention.

BRIEF SUMMARY OF THE INVENTION

Briefly stated, the auxiliary children's pool apparatus that forms the basis of the present invention comprises in general, an adjustable framework unit supporting a floor unit and further provided with an enclosure unit and a netting unit. The enclosure unit completely surrounds the floor unit and the netting unit extends only partially around the enclosure unit.

As will be explained in greater detail further on in the specification, the adjustable framework unit includes a central support column that is attached to a plurality of vertical support legs by a plurality of radial support arms wherein the height of the central support column is adjustable and the support legs are provided with adjustable collar elements for varying the height of the radial support arms relative to the vertical support legs.

In this manner, the height of the floor unit may be varied relative to the bottom of a conventional above ground swimming pool construction to enclose and support small children at a height above the true depth of the water in the swimming pool.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
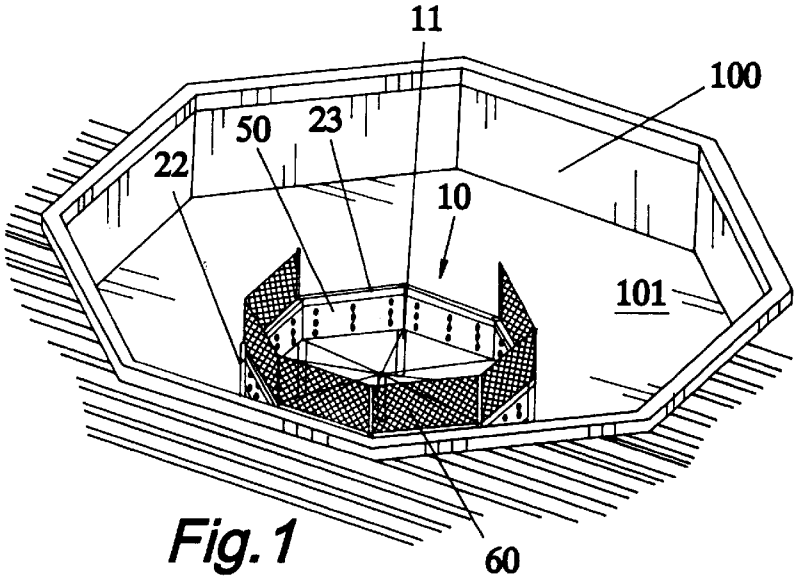
FIG. 1 is a perspective view of the auxiliary children's pool apparatus deployed in an above ground pool.

As can be seen by reference to the drawings, and in particularly to FIG. 1, the auxiliary children's pool apparatus that forms the basis of the present invention is designated generally by the reference number 10. The apparatus 10 is specifically designed and intended to be disposed within the confines of a conventional above ground pool construction 100 to provide an elevated support for children within the conventional pool construction 100 whereby young children can be contained and supported within an enclosure which is raised above the bottom 101 of the conventional above ground pool construction.

Figure 2:
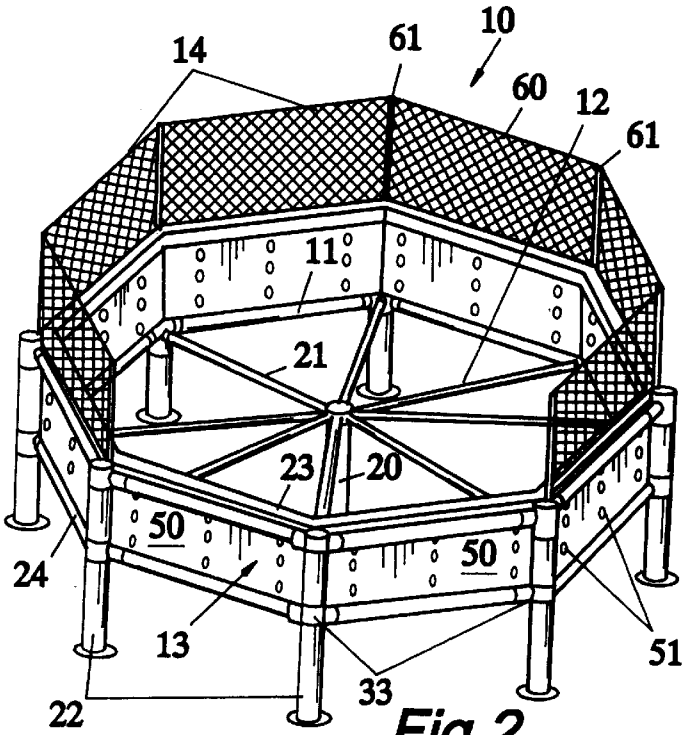
FIG. 2 is an isolated perspective view of the auxiliary children's pool apparatus.

As can best be seen by reference to FIG. 2, the auxiliary pool construction 10 includes an adjustable framework unit 11, a floor unit 12, an enclosure unit 13, and a net unit 14. These units will now be described in seriatim fashion.

The adjustable framework unit 11 comprises a central support column 20 operatively connected by a plurality of radial support arms 21 to a plurality of vertical support legs 22 which are connected to one another by a plurality of upper support arms 23 and a plurality of lower support arms 24.

Figure 3:
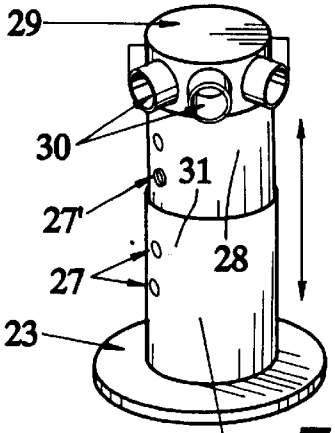
FIG. 3 is an isolated perspective view of the central support column.

As can best be seen by reference to FIG. 3, the central support column 20 comprises a lower enlarged column segment 25 having a flared base 26. The lower column segment 25 is provided with a plurality of vertically aligned adjustment apertures 27 and is further dimensioned to slidably receive a reduced diameter upper column segment 28. The upper column segment 28 is further provided with a cap element 29 having a plurality of radially aligned cylindrical hubs 30 and a like plurality of adjustment apertures 27' which are dimensioned to receive a locking pin 31 for adjusting the relative height of the central support column 20 in a well recognized fashion.

Figure 8:
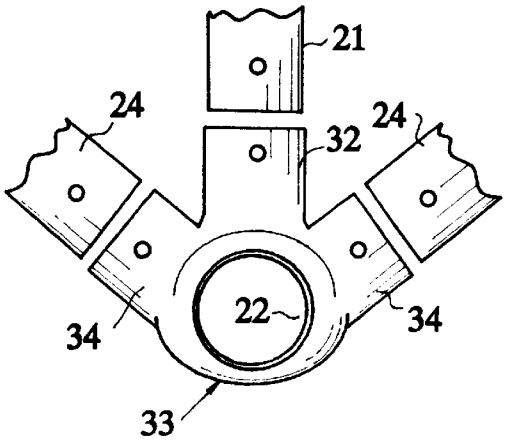
FIG. 8 is a top plan view of the arrangement depicted in FIG. 5.
Figure 5:
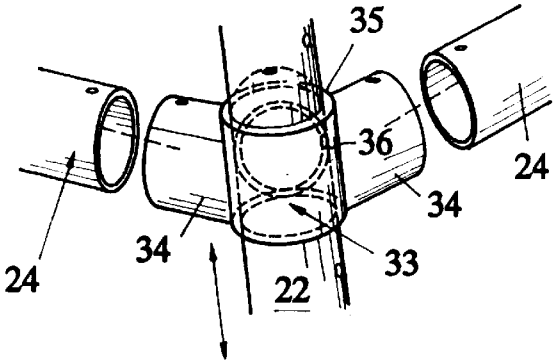
FIG. 5 is an exploded perspective view of the adjustable collar support member and two of the peripheral support arms.

As shown in FIGS. 5 and 8, the hubs 30 on the central support column 20 are dimensioned to receive the inboard ends of the radial support arms 21, whereas, the outboard ends of the radial support arms 21 are dimensioned to be received in a central hub 32 of an adjustable collar element 33 having a pair of outwardly extending hub arms 34. Each hub arm 34 is dimensioned to receive one end of one of the plurality of lower support arms 24.

Furthermore, the adjustable collar element 33 is provided with a vertical cylindrical section 35 which is dimensioned to slidably receive one of the plurality of vertical support legs 22. The cylindrical section 35 is further provided with an aperture 36 dimensioned to receive a locking pin 31 (not shown) for fixedly securing the collar element 33 at a desired height on the support leg 22.

Figure 6:
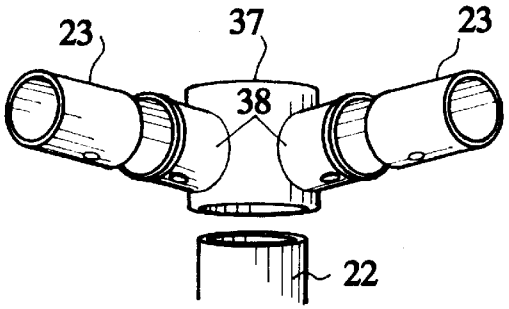
FIG. 6 is an exploded perspective view of the upper support arm structure.

As can best be seen by reference to FIGS. 6 and 7, the upper ends of each of the support legs 22 are provided with a cap element 37 provided with a pair of outwardly projecting hub arms 38 which are dimensioned to receive the ends of the upper support arms 23 and a vertical support tube 39 which is dimensioned to receive a portion of the net unit 14 as will be explained in greater detail further on in the specification.

Figure 4:
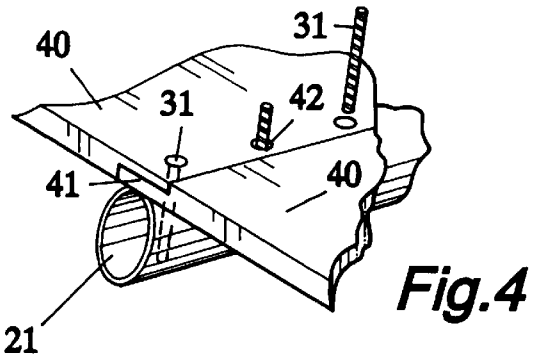
FIG. 4 is an isolated detail view of the juncture of the floor panels with one of the radial arm supports.

As shown in FIGS. 2 and 4, the floor unit 12 comprises a plurality of floor panels 40 having lapped joints 41 and a plurality of aligned apertures 42 dimensioned to receive locking pins 31 which extend into complementary apertures (not shown) in the radial support arms 21 for attaching the floor panels 40 to the radial support arms 21. Furthermore, in the preferred embodiment of this invention, the floor panels 40 are fabricated from LUCITE® or other generally clear plastic material.

Figure 7:
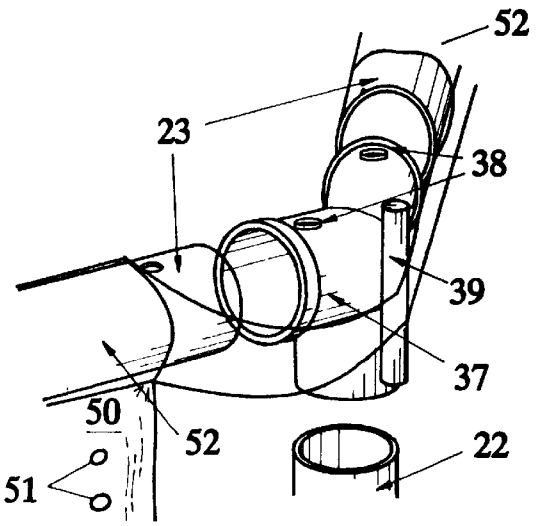
FIG. 7 is an exploded perspective view of the safety net liner holder.

Turning now to FIGS. 1, 2, and 7, it can be seen that the enclosure unit 13 comprises a plurality of flexible liner panels 50 which extend between the upper 23 and lower 24 support arms. The liner panels 50 are provided with a plurality of flow apertures 51 that allow water from the pool 100 to circulate within the auxiliary pool apparatus 10. In addition, the upper and lower ends of the liner panels 50 are provided with sleeves 52 that are dimensioned to slidably receive the upper 23 and lower 24 support arms.

Furthermore, the netting unit 14 comprises a length of netting material 60 affixed to a plurality of support rods 61. The lower ends of the support rods 61 are dimensioned to be received in the vertical support tubes 39 on the cap elements 37.

As can also be seen by reference to FIGS. 1 and 2, the netting unit 14 only partially surrounds the auxiliary pool apparatus 10 to allow children to enter and exit from the apparatus 10 at a convenient location.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. An auxiliary children's pool apparatus for providing an adjustable height support enclosure above the flat bottom of a conventional above ground pool construction wherein the apparatus includes:

a framework unit including a central support column operatively connected to a plurality of vertical support legs by a plurality of radial support arms wherein the vertical support legs are connected to one another by a plurality of upper support arms and a plurality of lower support arms;

an enclosure unit suspended between the upper and lower support arms;

a floor unit including a plurality of floor panels connected to one another and to said radial support arms; and first adjustment means for raising and lowering the floor unit relative to said central support column and said plurality of vertical support legs.

2. The apparatus as in claim 1 further including:

a netting unit suspended above and operatively associated with said plurality of upper support arms.

3. The apparatus as in claim 1 wherein said central support column comprises a lower column segment having an enlarged base, an upper column segment slidably received by said lower column segment and a locking pin for securing the column segments together at a desired height.

4. The apparatus as in claim 3 wherein the radial support arms and the lower support arms are operatively connected to the vertical support legs by a plurality of adjustable collar elements.

5. The apparatus as in claim 4 wherein each of the adjustable collar elements comprises a vertical cylindrical section dimensioned to receive one of the vertical support legs.

6. The apparatus as in claim 5 wherein the vertical cylindrical section is provided with a central hub and a pair of outwardly extending hub arms.

7. The apparatus as in claim 5 wherein the vertical cylindrical section is further provided with an aperture dimensioned to receive a locking pin for securing the adjustable collar element at a desired height relative to a vertical support leg.

8. The apparatus as in claim 4 wherein the upper support arms are connected to the vertical support legs by a plurality of cap elements.

9. The apparatus as in claim 8 wherein each of the cap elements are provided with a pair of outwardly projecting hub arms wherein each hub arm is dimensioned to receive one end of one of the plurality of upper support arms.

10. The apparatus as in claim 8 wherein selected ones of the cap elements are provided with support tubes.

11. The apparatus as in claim 10 further including:

a netting unit comprising a length of netting material affixed to a plurality of support rods wherein the support rods are dimensioned to be received in said support tubes.

12. The apparatus as in claim 11 wherein said netting unit only partially surrounds the periphery of the apparatus as defined by the upper support arms.

13. The apparatus as in claim 1 wherein the enclosure unit comprises a plurality of flexible liner panels having sleeve elements formed on their upper and lower ends to receive said upper and lower support arms.

14. The apparatus as in claim 13 wherein each of the liner panels are provided with a plurality of flow apertures.

* * * * *